US007044315B2

(12) United States Patent
Willim

(10) Patent No.: US 7,044,315 B2
(45) Date of Patent: May 16, 2006

(54) TELESCOPIC BOOM OF A CRANE

(75) Inventor: Hans-Dieter Willim, Ulm (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 138 days.

(21) Appl. No.: 10/454,990

(22) Filed: Jun. 5, 2003

(65) Prior Publication Data

US 2004/0060887 A1 Apr. 1, 2004

(30) Foreign Application Priority Data

Jun. 5, 2002 (DE) ..... 202 08 740 U
Dec. 10, 2002 (DE) ..... 102 57 658

(51) Int. Cl.
*B66C 23/42* (2006.01)

(52) U.S. Cl. ..... 212/299; 52/118; 52/149; 212/347

(58) Field of Classification Search ..... 212/298, 212/299, 300, 347; 52/14–151
See application file for complete search history.

(56) References Cited

U.S. PATENT DOCUMENTS 981,268 A * 1/1911 Hurd ..... 212/287
4,850,161 A * 7/1989 McGinnis ..... 52/108
6,550,624 B1 * 4/2003 Irsh et al. ..... 212/299

FOREIGN PATENT DOCUMENTS

| | | |
|---|---|---|
| DE | 3113763 | 10/1982 |
| DE | 20002748 | 8/2000 |
| DE | 10022658 | 3/2001 |
| DE | 20020974 | 4/2002 |
| DE | 10062517 | 6/2002 |
| DE | 10129022 | 1/2003 |

* cited by examiner

*Primary Examiner*—Thomas J. Brahan
(74) *Attorney, Agent, or Firm*—Dilworth & Barrese, LLP

(57) ABSTRACT

The within invention concerns a telescopic boom of a crane with a pivot section, telescoping sections that telescope out of the pivot section, and bracing that has at least one guy support housed on one of the sections and a guy cable supported on one of these guy supports. According to the invention, the telescopic crane is characterized by the presence of a guy cable running from the guy support and a cable lock that can be locked to said guy cable, in which the cable lock can be moved by means of an actuator, particularly an hydraulic cylinder, in the longitudinal direction of the guy and the guy cable can be pre-stressed by moving the cable lock.

20 Claims, 13 Drawing Sheets

TELESCOPIC BOOM OF A CRANE

The within invention concerns a telescopic boom of a crane with a pivot section, sections that telescope out of the pivot section, and bracing that has at least one guy support housed on one of the sections as well as a guy cable supported on the guy supports.

BACKGROUND OF THE INVENTION

In order to achieve lateral support as well for telescopic booms, for example support against wind forces, guy supports that can not only be raised but can also be opened out into a V can be used. DE 100 22 658 A1 shows an appropriate telescopic boom in which the guy supports are pivoted on a swivel frame that is attached in such manner that it can swivel on top of the pivot section. The guy supports can be raised by swiveling the swivel frame. Additionally, the guy supports can be swiveled relative to the swivel frame so that they can be pressed open into a V. Here the guy supports are activated by means of an appropriate hydraulic cylinder. On the one hand, hydraulic cylinders are pivoted to the pivot section so as to raise the guy supports together with the swivel frame. On the other hand, hydraulic cylinders are pivoted to the swivel frame and the guy supports to adjust the angle of the guy supports relative to the swivel frame. This known arrangement makes it possible to adjust the angle opening of the guy supports independent of the raising of the guy support arrangement. On the other hand, however, it is cumbersome and its complicated construction makes it relatively expensive.

At their free projecting ends, the guy supports are connected with guy cables that run from the guy supports. When the telescopic boom is extended, and after appropriate raising of the guy supports, the guy cables are pulled out from the ends of the guy supports. With the boom in extended position, the guy cables fastened to the tip of the telescopic boom or also to the collar of one of the outward-telescoped section must be fastened at their support-side ends to the guy supports, with the guy supports in turn being held at the foot of the boom pivot unit. The guy cables can be supported on the guy supports by means of, for example, appropriate coils from which the guy cables run. However, because of the powerful forces, such coils must be of an appropriate size, and are therefore correspondingly heavy. Also, fastening the guy cables by means of cable clamps has already been proposed. However, it requires much effort to attach the cables in precisely the desired extended length. Additionally, there are objections with respect to long-term operating safety of such cable clamps.

It is therefore the task of the within invention to create an improved telescopic boom, of the type initially described, that avoids the disadvantages of the state of the art and improves on said state of the art in an advantageous manner. Preferably, a lightweight, simply constructed guy that permits simple, secure attachment of the guy cables in their desired extended length, as well as pre-stressing of the guy cables, should be created.

The task is performed according to the invention by a telescopic boom described herein. Preferred embodiments are also the subject herein;

According to the within invention, the extended guy cables can thus be positively engaged with the guy supports in their individual extended position. For this purpose, according to the invention, the guy cables have areas that are thickened, and the guy supports have appropriate cable locks that can be positively engaged with the thickened areas on the guy cables. The guy cables are thus attached to the guy supports not by means of an appropriate coil or a cable clamp mechanism, but rather by positive engagement by means of the said cable lock. By eliminating a cable coil for collecting the guy cable forces, the corresponding expensive and heavy coils and the heavy structure resulting therefrom can be avoided. Additionally, the problems of a cable clamp are eliminated. With the cable clamp the drawn-out cable lengths must be grasped precisely so that the cable will be clamped at the correct place. Another problem is the risk of build-up of dirt, so that the clamp effect changes with the change in friction coefficients during operation, whereupon a considerable potential danger can arise. In contrast, the solution of the cable lock according to the invention offers the advantage of ease of embodiment. At the same time the individual guy cable is gripped at precisely the designed length, which is predetermined by the permanently positioned thickened areas.

Preferably, the guy cable can be attached in several pre-determined lengths to the individual guy support. In a further development of the invention, each guy cable has thickened areas positioned at predetermined intervals, and the cable lock is designed in such manner that the individual guy cable with one or more thickened areas can run over the cable lock or can travel, with the individual thickened area, into the cable lock and can be locked there, as desired. To permit the individual thickened area to travel through or be attached to the cable lock, preferably the cable lock can have a mobile locking unit that can travel into and out of the path of the running cable. Preferably a swivel-locking piece that can swivel onto and can be swiveled away from the running guy cable can be provided. As activating device, preferably a pressure cylinder can be used, by means of which the locking piece of the cable lock can be swiveled appropriately.

The thickened areas can be designed in various ways. According to one advantageous embodiment of the invention, the thickened areas, which form radial projections on the cable, consist of clamping sleeves that are molded to the guy cable.

In guy cables with molded cable clamps or corresponding thickened areas, there is the problem that the guy cable cannot reasonably be wound on a drum. To assist with this problem, a cable pulley, positioned preferably inside the guy supports, into which the individual guy cable can be drawn, is used as a cable storage device, instead of a drum. Preferably the cable pulley has multiple channels, so that with the limited length of the individual guy support an adequate guy cable length can nevertheless be drawn in. In particular, several deflection pulleys can be positioned inside and at the ends of the guy supports, on which said deflection pulleys the guy cable is appropriately looped when the telescopic boom is readied for transportation and the guy cable is stowed away appropriately.

To permit the guy cable to be drawn through the individual cable pulley without problems, in a further development of the invention auxiliary cables are attached to the ends of the guy cables, which said auxiliary cables are drawn into the cable pulleys and can be wound on appropriate auxiliary coils. If the individual guy cable is to be drawn into the cable pulley, the auxiliary cable is wound on the auxiliary coil, so that the guy cable instead of the auxiliary cable is drawn into the cable pulley. Preferably, the auxiliary cable can have a considerably smaller diameter and/or with respect to its tensile strength can be weaker than the guy cable. The auxiliary cables are not used to collect the guy forces. These forces are collected by means of the aforementioned cable lock. When the guy cables are completely extended, the cables are no longer in the cable pulleys, into which only the individual auxiliary cable is drawn. The auxiliary coil for winding the individual auxiliary cable is preferably likewise positioned inside the guy supports.

Booms that are very long often bend, which is detrimental to the load-bearing capacity of the telescopic boom. When the boom bends, the force component acting in the longitudinal boom direction also receives a lever arm, so that the boom bends still further. It would therefore be very desirable to intercept and prevent bending already in the early stages by means of guy cables. However, this is difficult with the customary guy cables, since said cables cannot be sufficiently pre-stressed. To assist in this activity, according to another aspect of the within invention it is proposed to activate the cable lock by means of an actuator, in particular a hydraulic cylinder, in the longitudinal direction of the cable, and thereby to support the guy cable. A pre-stressing of the guy cable or cables can thereby be achieved, so that the bracing becomes effective already at a very early stage and the bending of the boom can be greatly reduced, particularly in the luffing of the tip. Lateral bending in particular can be clearly reduced by means of this new type of bracing. Accordingly, the column consisting of boom and, for example, luffing tip can be straightened or kept straight at a very early stage. By means of the hydraulic cylinder, considerable pre-stress can be placed on the guy cable. It is understood that the pre-stressing of the guy support by means of the cable lock actuator independent of the above-described positive locking between the cable lock and the thickened areas offers special advantages. If appropriate, the guy cable could also be designed without thickened areas and a frictionally engaged cable clamp can be provided as cable lock. In frictional-engagement locking as well, pre-stressing can be achieved by hydraulic-drive movement of the cable lock. However, the preferred form is the above-described positive engagement lock between the cable lock and the guy cable or the thickened positioned on the guy cable.

In another development of the invention, the cable lock is guided into a preferably corridor-type guide in such manner that the cable lock can be moved along a first adjustment path segment into engagement with or disengagement from the guy line, and when locked can be moved along a connecting second adjustment path segment in the longitudinal direction of the cable. The cable lock is thus initially moved crossways to the cable by means of a movement component and is locked. The locked cable lock is then led longitudinally along the cable in order to pre-stress the guy cable. To release the cable, the process is reversed. As soon as the cable lock reaches the guide in the first adjustment path segment, a movement component moves it away from the cable crossways to the cable.

In another development of the invention, the actuator hydraulic cylinder with its piston rod can be pivoted to swivel on the guy supports, and with its cylinder can carry the cable lock and can be led into the corridor-like guide. If the hydraulic cylinder is moved toward or away in relation to the piston rod, it follows the travel path predetermined by the guide. Theoretically it would of course also be possible to pivot the hydraulic cylinder to swivel on the guy supports and to guide the piston rod into the corridor-like guide. It would also be conceivable, instead of the corridor-like guide, to intercept the lateral swivel movement of the hydraulic cylinder by means of an additional actuator. However, the preferred embodiment is to pivot the piston rod and to attach the cable lock to the cylinder collar, from which the piston rod protrudes. In this way a particularly compact arrangement can be achieved.

To collect lateral forces as well, the guy supports can preferably be pressed open into a V, in which each of the guy supports can be housed to swivel on two separate swivel axes. Advantageously, each of the guy supports can be given just a single swivel cylinder, with the help of which the individual guy support can be swiveled if appropriate on its two swivel axes.

Advantageously, the guy supports have no inter-connections, that is, there are no anti-roll bars, lever mechanisms, etc., between the guy supports. The guy supports are pivoted to the boom lock at their boom ends only, and are connected with the pertinent swivel cylinder. This results in a particularly simple assembly of the guy support arrangement.

BRIEF DESCRIPTION OF THE DRAWINGS

The invention is explained below in greater detail by means of a preferred embodiment and pertinent drawings that show.

DESCRIPTION OF THE PREFERRED EMBODIMENTS

Figure 1:
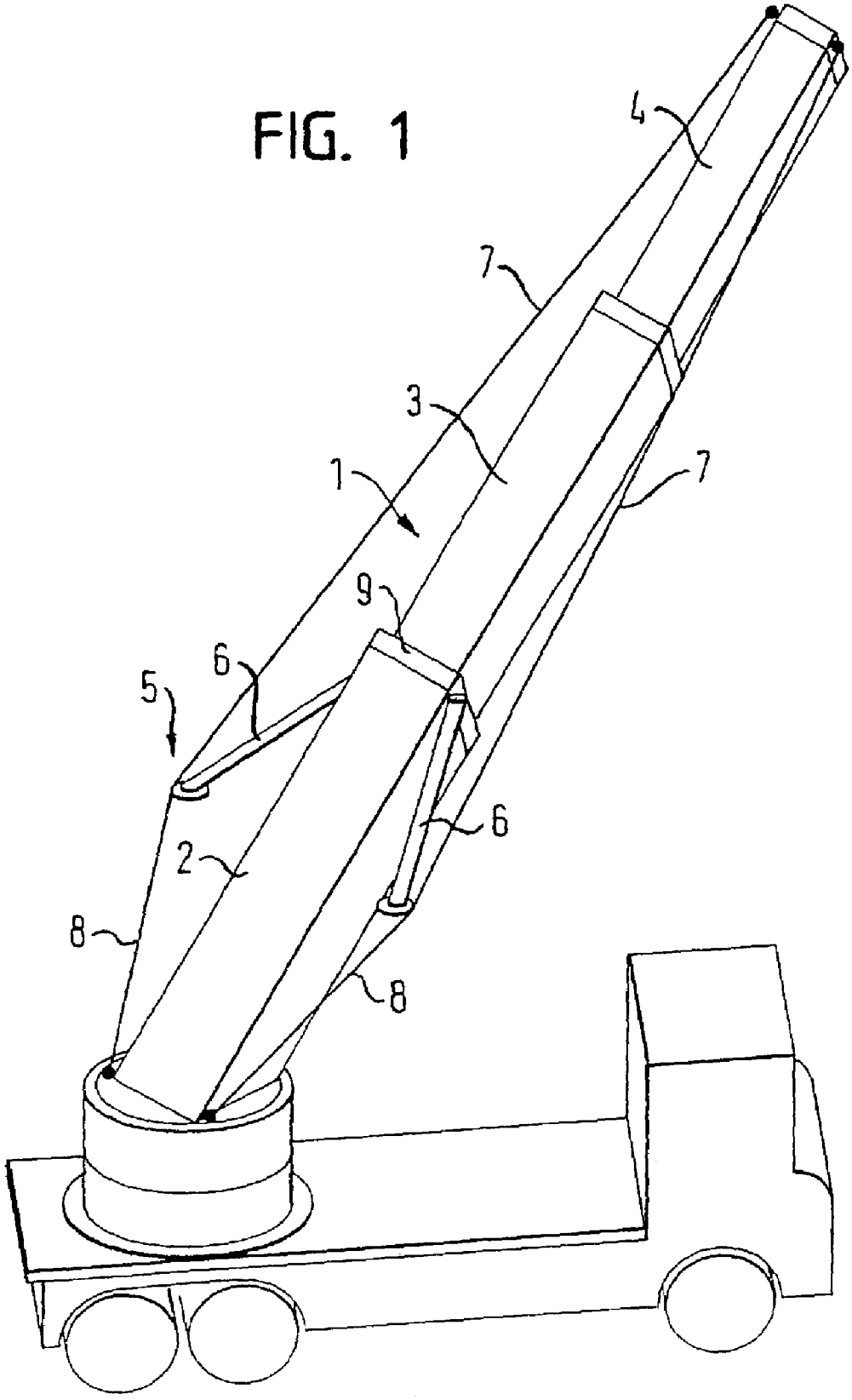
FIG. 1 a perspective view of a traveling crane with a telescopic boom having lateral bracing with V-shaped spread guy supports, according to a preferred embodiment of the invention, FIG. 2 an enlarged view of the pivot section of the telescopic boom with a guy support pivoted to it, which said guy support is shown in transportation position, folded to the pivot section, FIG. 3 an illustration of the pivoted housing of the guy supports pivoted on the collar of the pivot section as well as of the hydraulic cylinder for spreading the guy supports apart, FIG. 4 an illustration of the pivoted housing of the guy supports from inside, showing the second hydraulic cylinder for raising the guy supports, FIG. 5 a perspective view of the pivot section with one of the guy supports pivoted to it, which is shown raised but not yet laterally spread, FIG. 6 a perspective view of the pivot section with one of the guy support pivoted to it, in which the guy is shown raised and laterally pressed open, FIG. 7 a skeletal illustration of a guy support that shows the guy cable guide and the cable pulley for the guy cable inside the guy support as well as the cable lock for locking the guy cable, with the guy cable drawn into the cable pulley, FIG. 8 an enlarged, sectional perspective illustration of the cable lock of FIG. 7 in unlocked position, FIG. 9 an enlarged, sectional illustration of the cable lock similar to FIG. 8, in which the cable lock is shown in inward-swiveled locking position, FIG. 10 a sectional illustration of the pivoted housing of a guy support on the collar of the pivot section according to an alternative embodiment of the invention, in which the guy support can be swiveled by a single hydraulic cylinder on two separate swivel axes, that is, raised, and spread apart, FIG. 11 a schematic illustration of a cable lock that can be adjusted by means of an actuator, with which the guy cable can be pre-stressed, according to another preferred embodiment of the invention, with the cable lock being shown in outward-swiveled position and not connected with the cable, FIG. 12 a schematic illustration of the cable lock of FIG. 11, in which the cable lock is already swiveled onto the cable but is not yet tightened, and FIG. 13 the cable lock of FIGS. 11 and 12, fully tightened.

FIG. 1 shows a traveling crane with a telescopic boom 1, which is pivoted on the vehicle so as to rotate on an upright swivel axis and to swivel on a horizontal axis. The telescopic boom 1 has a pivot section 2 that is pivoted to the vehicle in known manner, as well as additional telescopic sections 3 and 4 that can be telescoped out of pivot section 2. A guy 5 of the telescopic boom 1 is guided over a pair of guy supports 6. Guy cables 7 run from the free end of guy supports 6 to the tip of telescopic boom 1. Via guy cables 8 the guy supports 6 are in turn caught at the pivot end of pivot section 2.

Guy supports 6 are not interconnected; rather, each is individually bolted laterally to collar 9 of pivot section 2. They can swivel on two swivel axes, so that they can raised out of their position during transportation, that is, parallel and folded against pivot section 2, and can be spread apart laterally so that the guy can collect both vertical and lateral forces.

Figure 2:
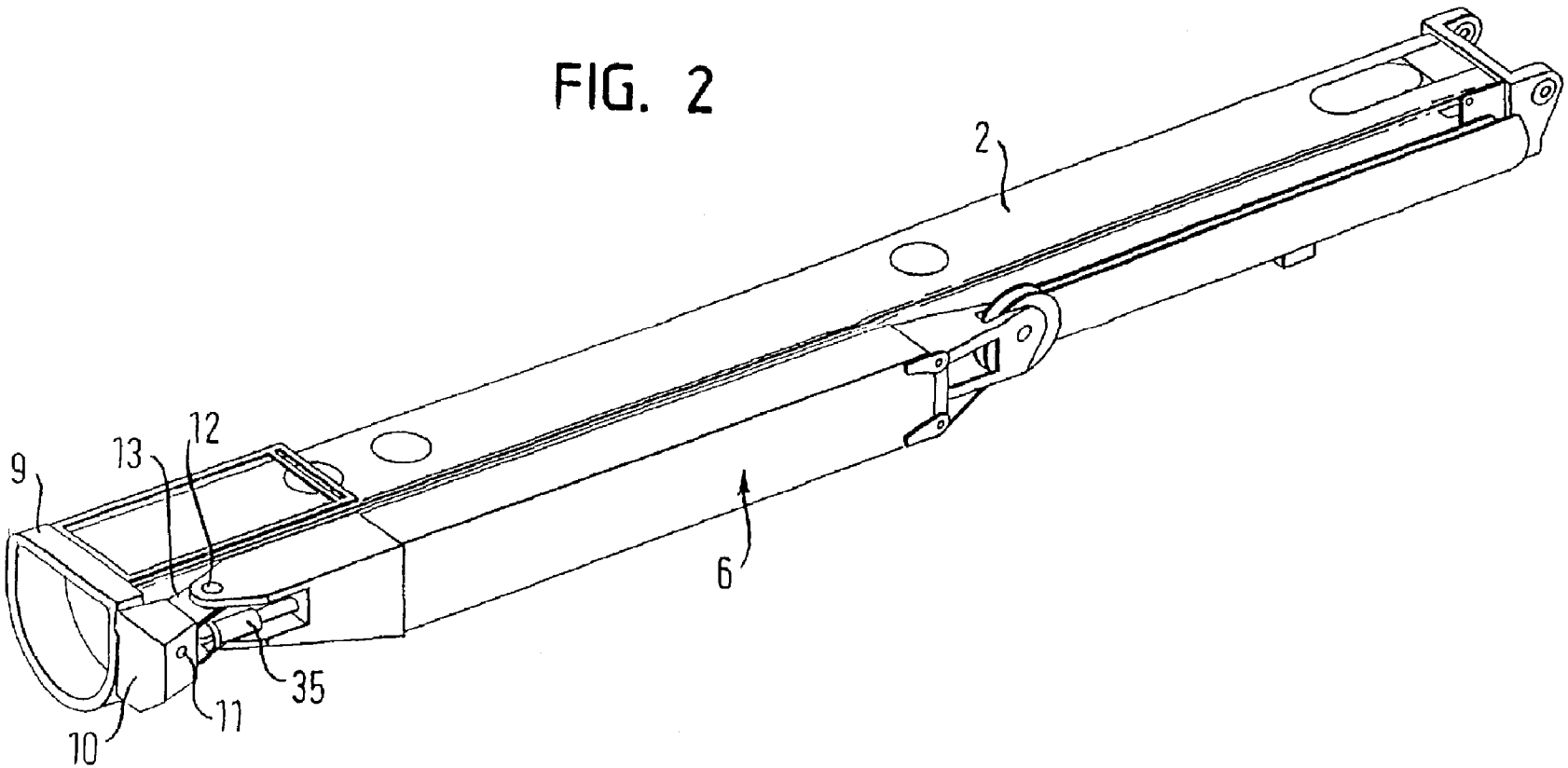
Figure 3:
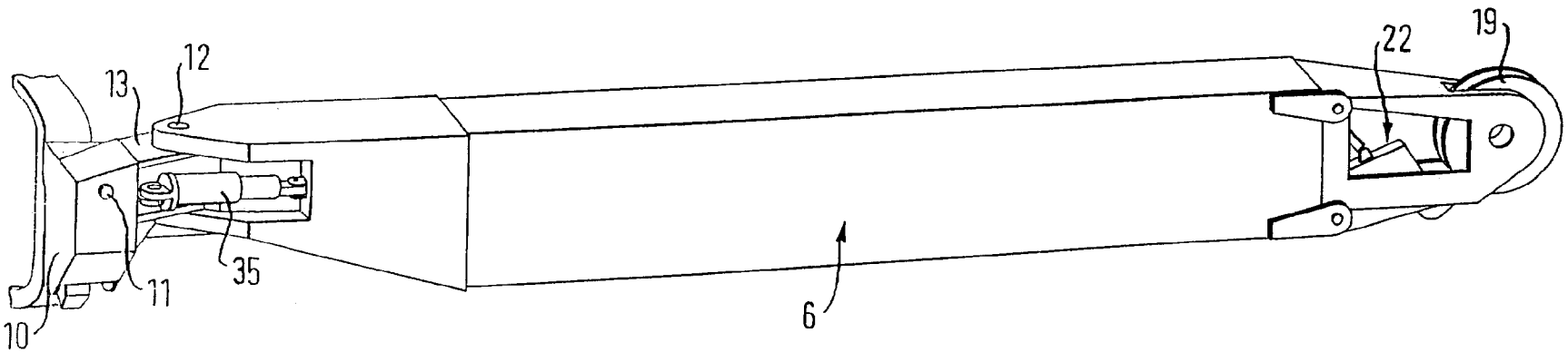

As shown in FIGS. 2 and 3, each guy support 6 is pivoted to a housing bracket 10 rigidly attached to collar 9 of pivot section 2. The housing brackets 10 are attached facing each other on the right and left sides on the pivot section 2. Guy supports 6 are gimbal-mounted on housing brackets 10. They can be swiveled individually on two separate swivel axes 11 and 12 on bracket 10. As shown in FIG. 3, a first swivel axis 11 extends essentially perpendicular to the vertical longitudinal plane of symmetry of the telescopic boom, while the second swivel axis 12 extends parallel to said longitudinal plane of symmetry of telescopic boom 1. On the housing bracket 10 a bearing part 13 can be swiveled on said first swivel axis 11. Guy support 6 is pivoted on this bearing part 13 to swivel on second swivel axis 12.

Figure 4:
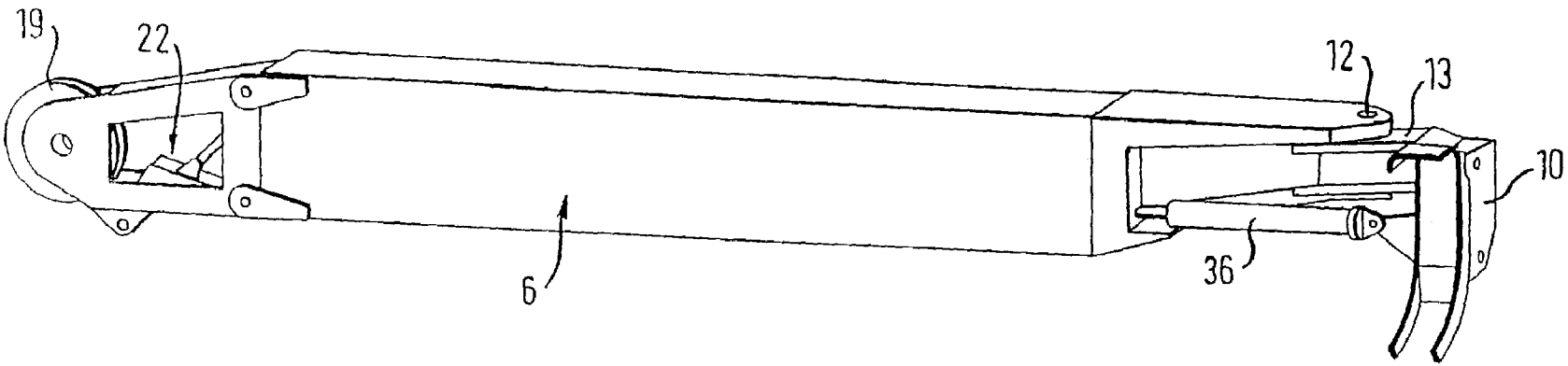
Figure 5:
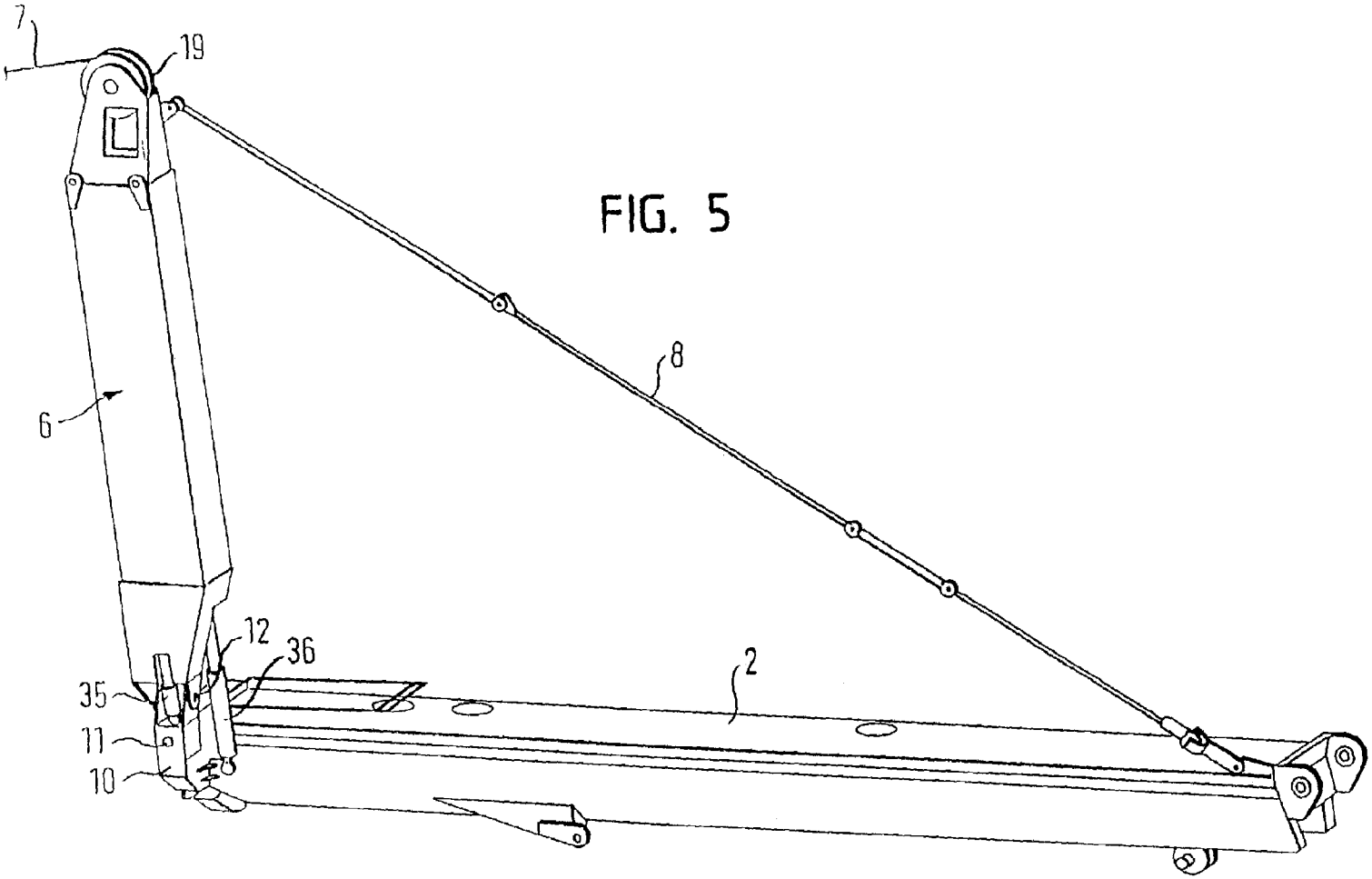

As shown in FIGS. 3, 4, and 5, a hydraulic cylinder 35 or 36 is allocated to each swivel axis. Each hydraulic cylinder is pivoted to the guy support on the one hand and on the other hand to bracket 10 or bearing part 13, so that the guy supports can be swiveled on the two swivel axes.

Figure 7:
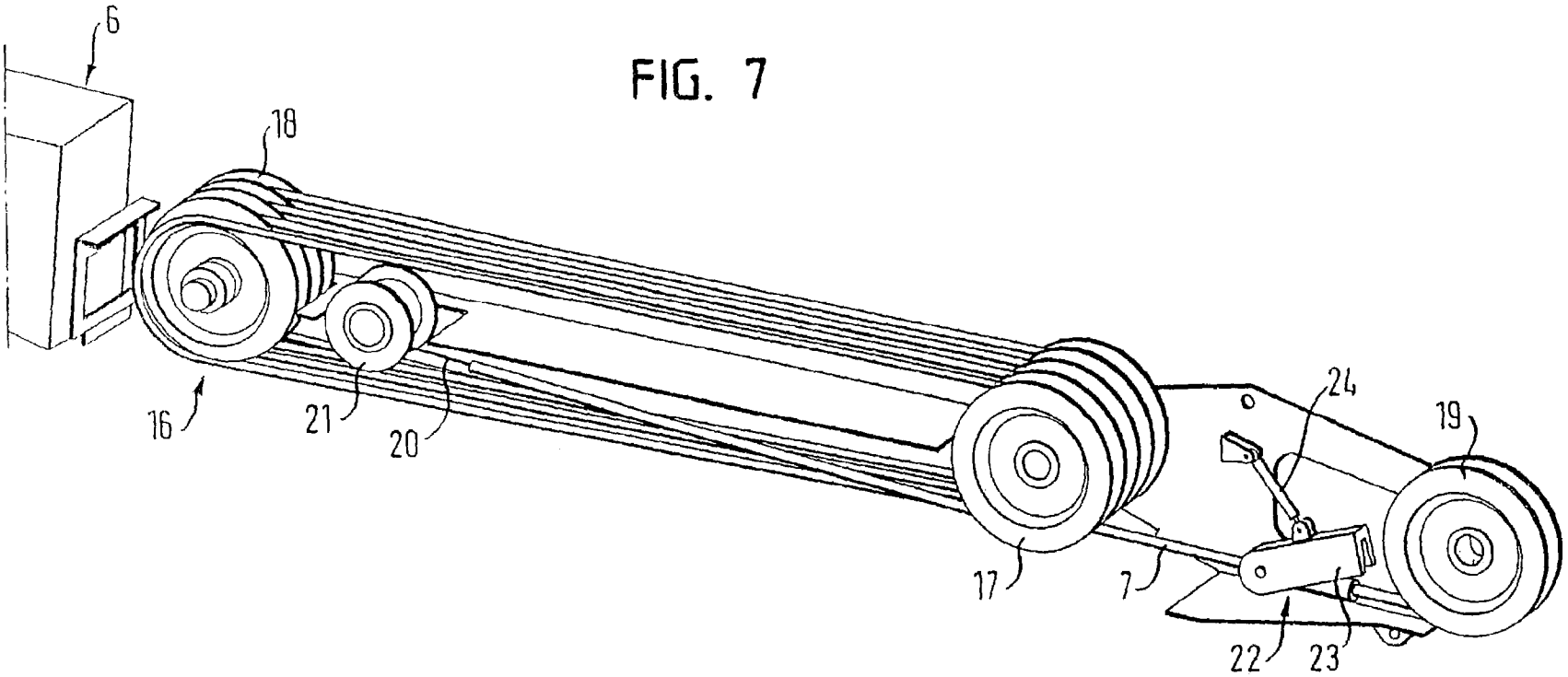

After the guy supports 6 have been raised, guy cables 7 are first drawn slightly out of guy supports 6 and are attached to the tip of the telescopic boom or to a collar of a telescopic section or to a crosspiece positioned thereon. As shown in FIG. 7, the guy cables 7 are not wound on a coil on the individual guy support 6, they are drawn into a cable pulley 16 inside the individual guy support 6. Each cable pulley 16 has two deflection roller blocks 17 and 18 with several deflection rollers, positioned at the ends in the individual guy supports 6. The multiple-lane nature of the cable pulley 16 ensures the availability of a sufficient cable path. At the free end of the individual guy support 6 the individual guy cable 7 is carried over a deflection pulley 19, whence it runs out to the telescopic boom tip.

After the guy cable has been bolted to the boom, the boom is moved into its steepest position and is telescoped outward, whereupon guy cables 7 are drawn out. About two meters before the target position is reached, the cable lock described in greater detail below is locked so that the thickened area of the cable is gripped. The telescopic sections are then bolted. Lastly, the guy supports can be opened out to form the desired V angle.

When the guy cable 7 is drawn out during the outward telescoping, the guy cable 7 is pulled out of cable pulley 16. To permit it to be retracted into the cable pulley 16, a thin auxiliary cable 20 is attached at the end of support cable 7, which said auxiliary cable 20 is drawn into the cable pulley 17 when support cable 7 is pulled out. Auxiliary cable 20 is preferably wound on an auxiliary coil 21 positioned inside guy support 6, as shown in FIG. 7. In order to draw the support cable back into cable pulley 16, auxiliary cable 20 is wound on auxiliary coil 21.

Figure 8:
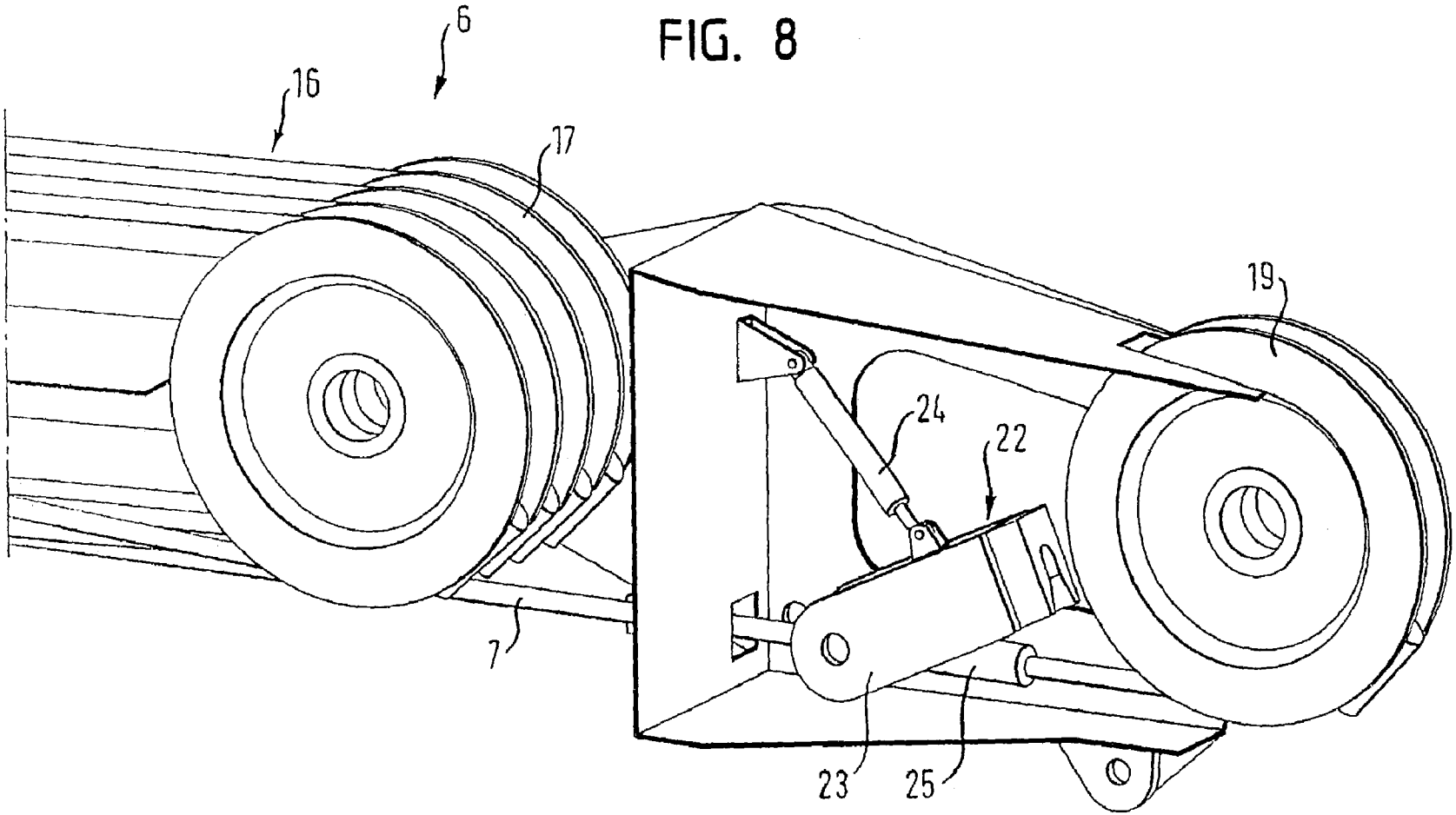
Figure 9:
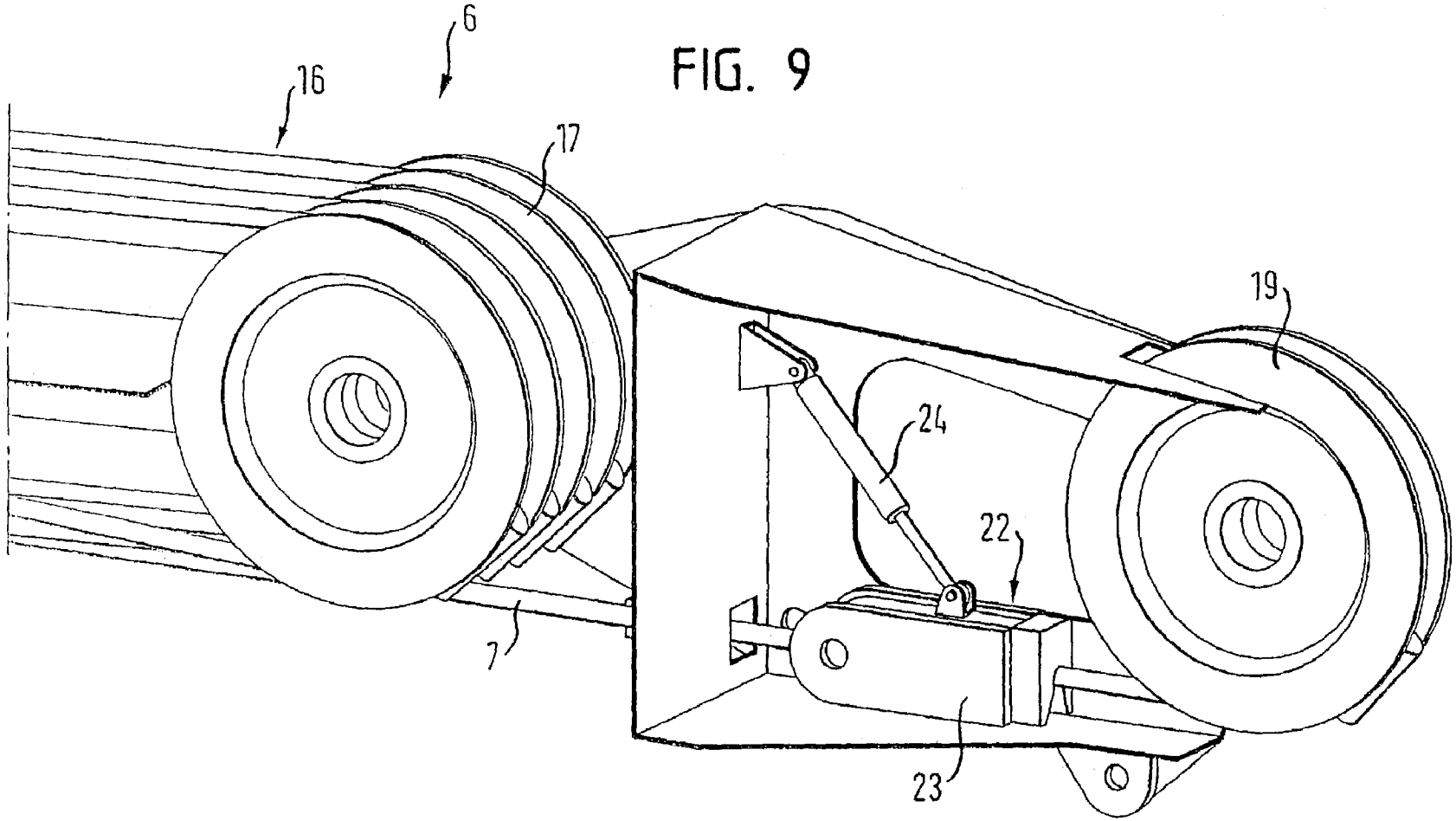

Needless to say, said auxiliary cable does not collect the support forces. For this purpose a cable lock 22 is provided, to which cable lock guy cable 7 can be positively adjusted. As shown in FIGS. 7 and 8, cable lock 22 is positioned at the free end of guy support 6 preferably between deflection roller 19 and cable pulley 16. Cable lock 22 has a swiveling locking piece 23 that is pivoted on the guy support steel structure to swivel on a swivel axis extending crosswise to the direction of the cable. By means of a hydraulic cylinder 24 the locking piece 23 can be swiveled onto the running guy cable 7 or can be swiveled out of the path of guy cable 7. FIG. 8 shows the outward-swiveled position, while FIG. 9 shows the inward-swiveled, locking position. Locking piece 23 is preferably housed to swivel on its traction side, that is, the left end in FIG. 9, so that even if the hydraulic cylinder 24 fails, the locked position will be held securely.

Locking piece 23 thereupon intercepts cable clamps 25 molded on guy cable 7, which said cable clamps 25 form thickened areas positioned at predetermined intervals on guy cable 7, so that the guy cable can be locked in various drawn-out lengths. When guy cable 7 is drawn out, locking piece 23 is first swiveled outward into the cable path, so that cable clamps 25, drawn out at the same time if appropriate, can be pulled out above the cable lock. As the cable clamps to be gripped near the cable lock, cable lock 22 is swiveled inward. When they are further drawn out, locking piece 23 grips the appropriate cable clamps 25 and engages with them positively. In this way a precisely determined desired length of guy cable can be brought out.

For disassembly of the boom or its restoration to transportation position, theoretically the same sequence of steps is performed in reverse. After the boom has been moved into its steepest position and the guy supports have been folded in, the guy cables can be pulled in. To retract the cable, cable lock 22 must first be unlocked, that is, locking piece 23 is swiveled inward. For this purpose the auxiliary cable is first activated to draw the cable thickness piece out of the cable lock so that the cable lock can be opened. The boom is then telescoped inward, and auxiliary coil 21 is activated to wind up auxiliary cable 20 and thereby draw guy cable 7 into cable pulley 16.

Figure 10:
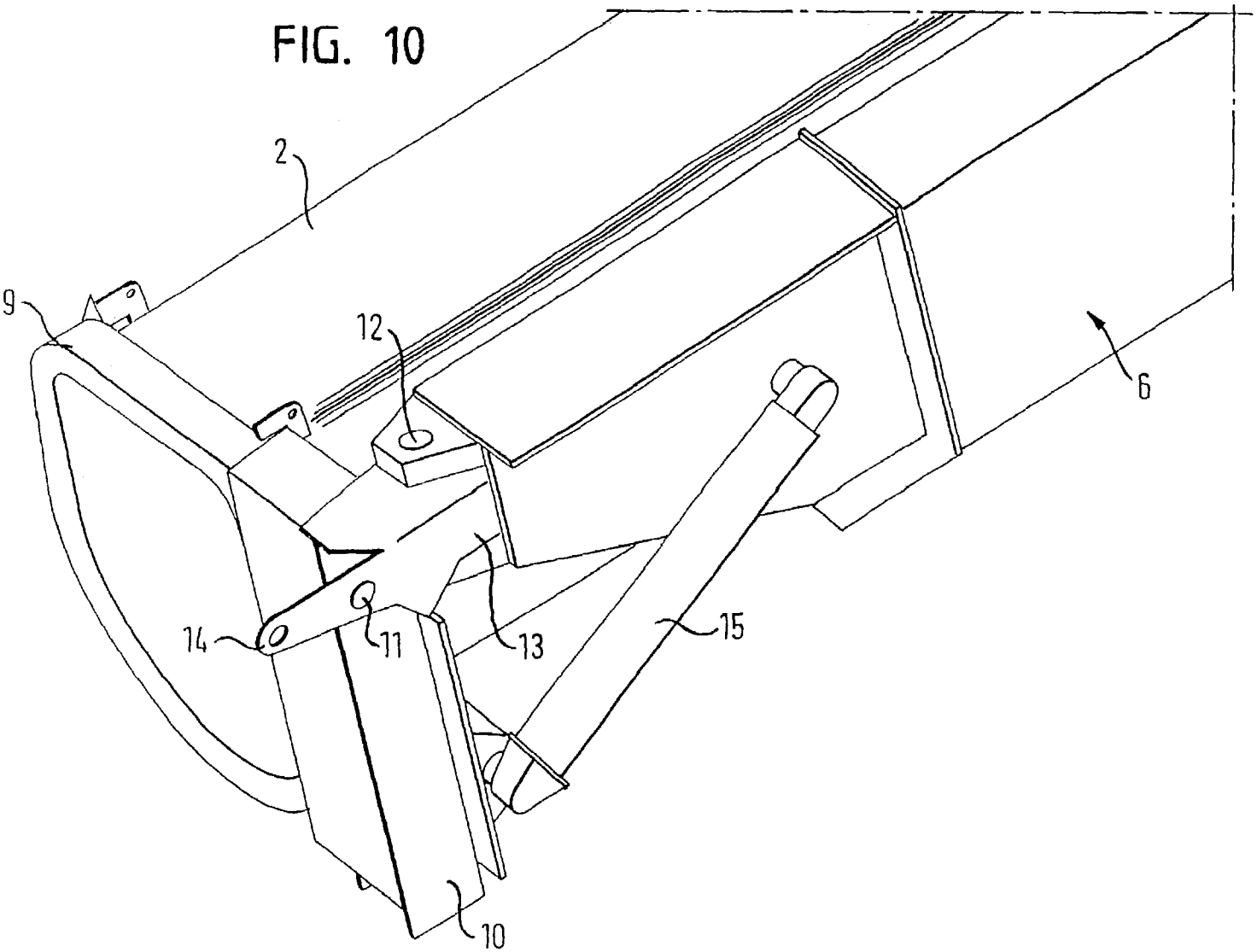

According to an alternative embodiment of the invention, shown in FIG. 10, a single hydraulic cylinder 15 can be provided to raise and spread guy supports 6. Said hydraulic cylinder 15 is pivoted to guy supports 6 on the one hand, and on the other hand is attached permanently to the boom, particularly to bearing bracket 10. To permit swiveling on both swivel axes 11 and 12, hydraulic cylinder 15 is pivoted in multi-axis manner to swivel at both ends. For example, a ball joint could be provided for this purpose. Preferably, hydraulic cylinder 15 is gimbal-mounted on both sides.

Each of the two swivel axes 11 and 12 has a swivel axis block that allows the individual swivel axis to be blocked. This can be done, for example, by means of a hydraulically activated locking pin, not illustrated individually in the drawing. Locking can thereby be done by means of appropriate locking arms on bearing piece 13, which said bearing arms block its mobility relative to bearing bracket 10 or guy support 6. FIG. 10 shows locking arm 14 of bearing piece 13, which said bearing piece 13 can be attached to bearing bracket 10, and the swiveling capability can thereby be locked on the first swivel axis 11.

The guy supports are raised and spread as follows:

FIG. 2 shows the guy supports 6 in transportation position, folded against the pivot section. Each of the guy supports 6 is first raised out of this position, that is, swiveled on swivel axis 11 into an upright position, as shown in FIG. 5. Swivel axis 11 is unlocked while the second swivel axis 12 is or remains locked. When hydraulic cylinder 15 is moved out, guy support 6 swivels on swivel axis 11, until it reaches the raised position shown in FIG. 5. First swivel axis 11 is locked in this position. It can be locked by causing locking pins housed on bearing bracket 10 to enter the locking hole in locking arm 14 of bearing piece 13. When the guy support is raised, locking arm 14 swivels into the appropriate position on bearing bracket 10 to align with the locking pins.

Figure 6:
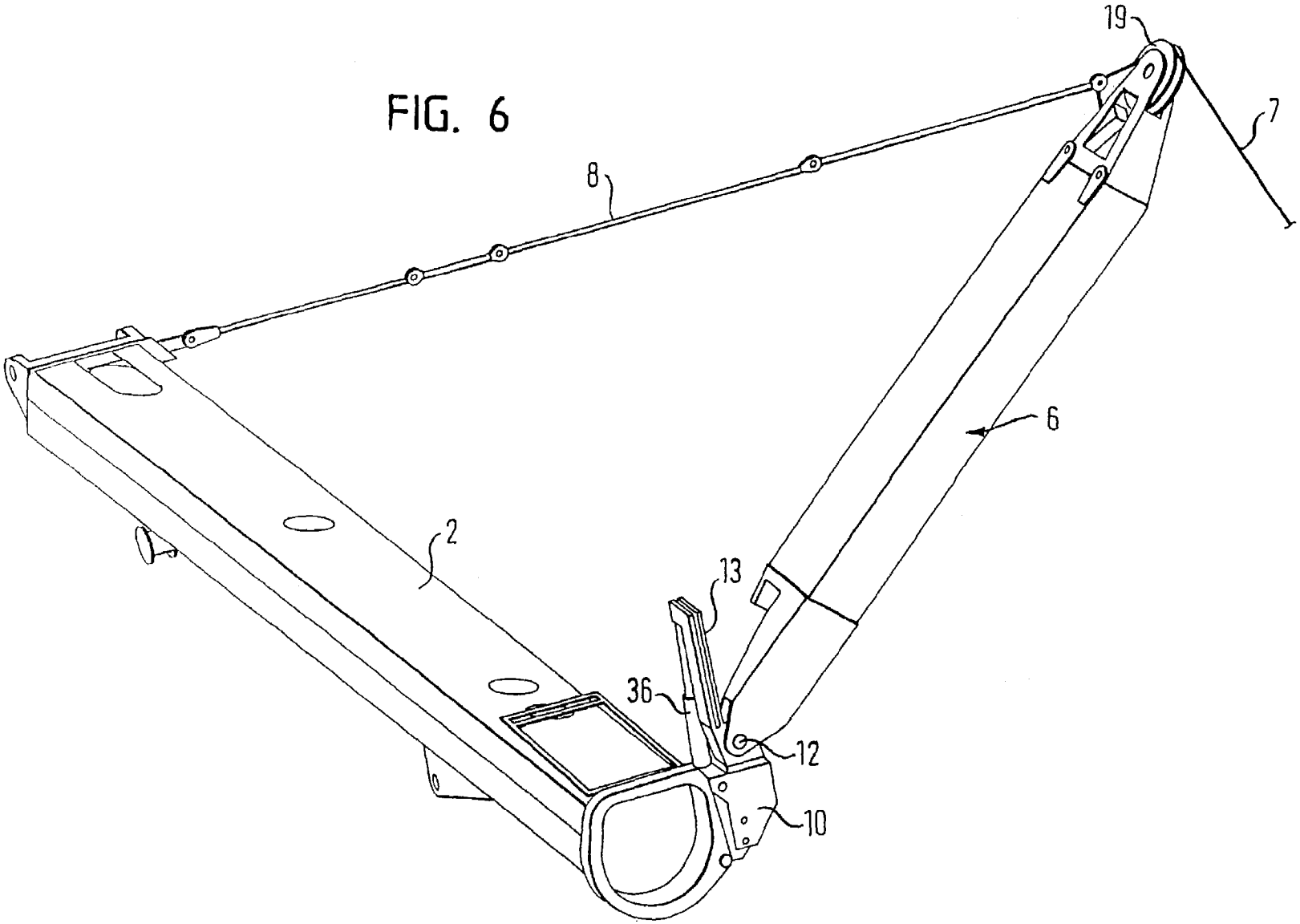

To open out guy supports 6 into a V shape, that is, to swivel them laterally from the longitudinal symmetry plane of the telescopic boom, after first swivel axis 11 is locked, swivel axis 12 is unlocked. Hydraulic cylinder 15 is then inserted, so that guy support 6 is swiveled laterally outward, as shown in FIG. 6. It is understood that to swivel guy support 6 back into transportation position, the same order of steps can be followed in reverse.

Figure 11:
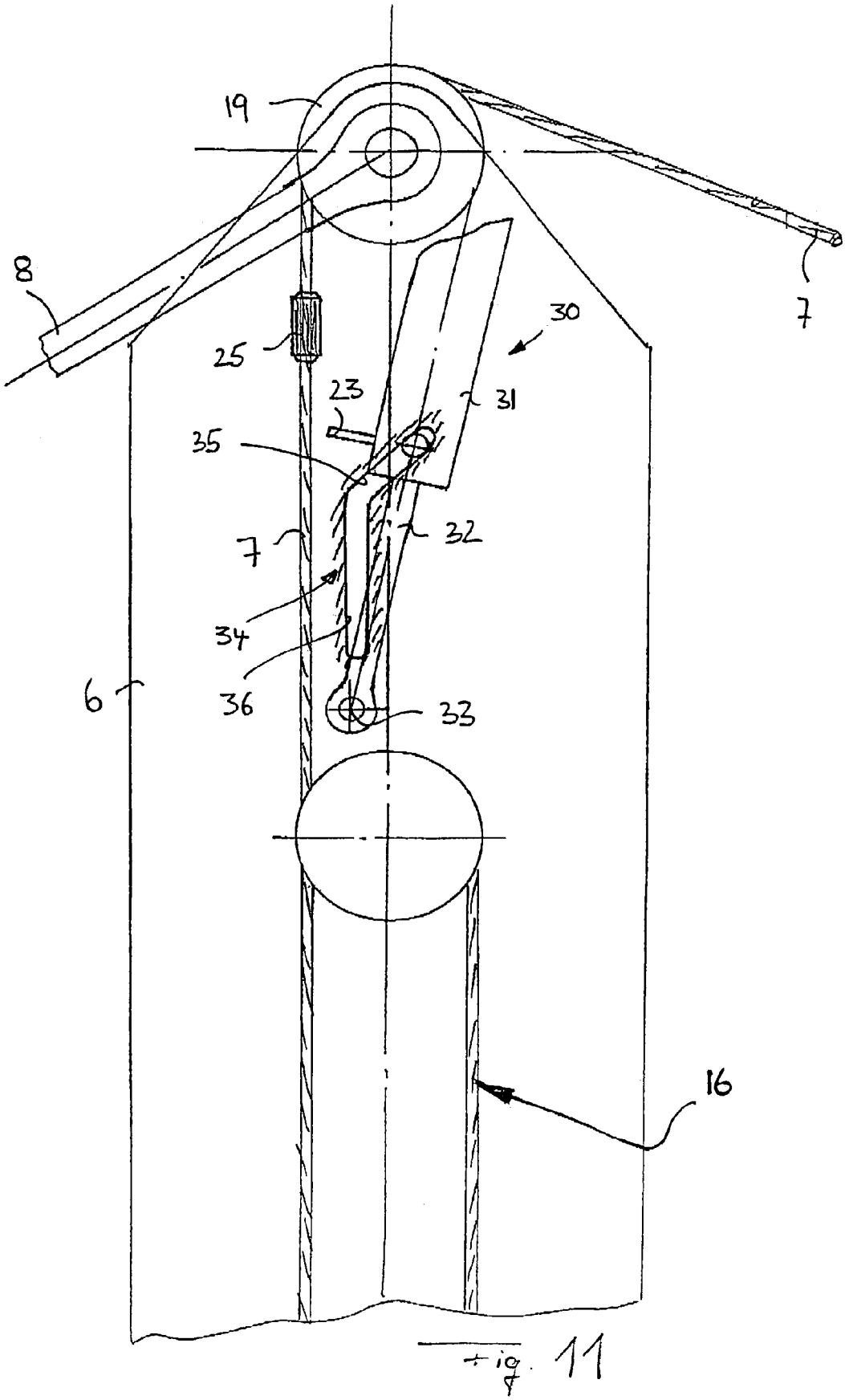
Figure 12:
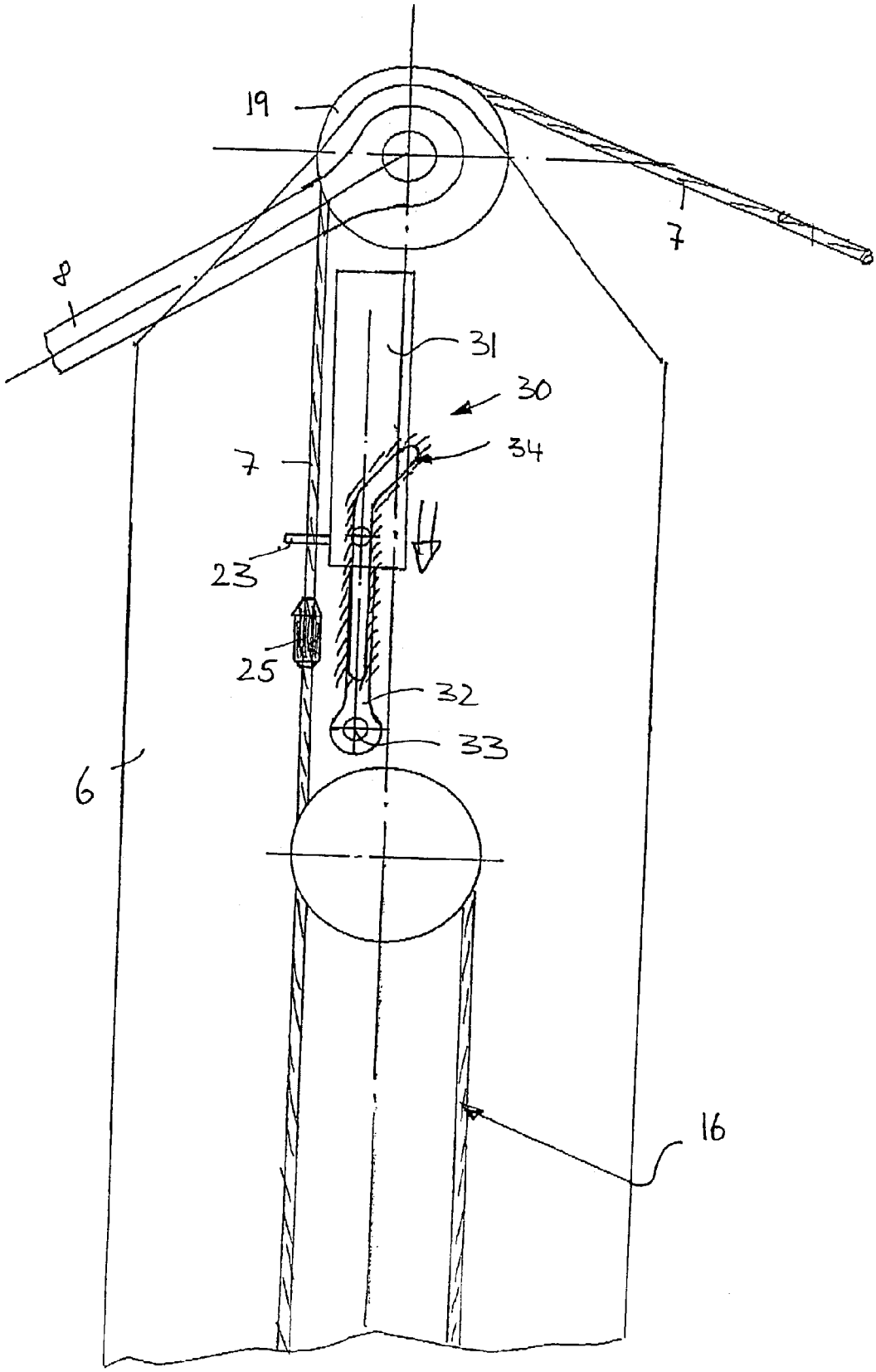
Figure 13:
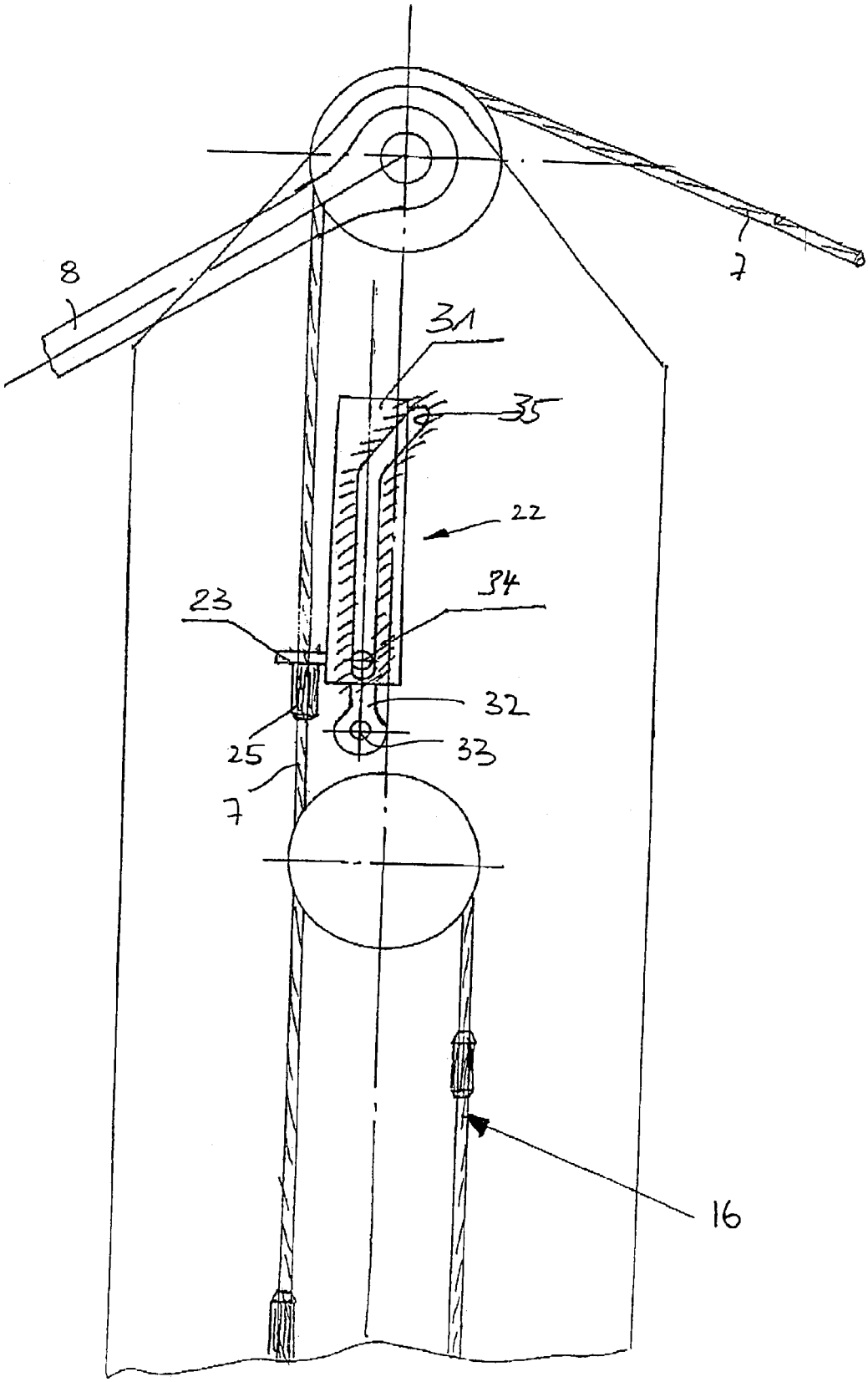

In the embodiment shown in FIGS. 11 to 13, cable lock 22 can not only be swiveled in and out, it can also be moved outward in the longitudinal direction of guy cable 7 in order to pre-stress said cable. As shown in FIG. 11, here too cable lock 22 has a locking piece 23 that can be adjusted positively to a cable clamp 25 pressed on guy cable 7. Locking piece 23 can be moved by means of an actuator, which in the embodiment shown is designed as hydraulic cylinder 30. As shown in FIG. 11, locking piece 23 is attached rigidly to hydraulic cylinder 30, or, more precisely, to cylinder collar section 31, from which piston rod 32 of piston cylinder unit 30 protrudes.

Piston rod 32 is jointed at its end 33 to the steel structure of guy supports 6. Cylinder 31 of the hydraulic cylinder unit is guided into a corridor-like guide 34, so that cylinder 31 as well as locking piece 23 attached to it travels a predetermined route when piston cylinder unit 30 is activated.

As shown in FIG. 11, guide 34 includes a first travel path segment 35 that runs crosswise, or more precisely on an oblique, to the longitudinal direction of guy cable 7. A second connecting travel path segment 36 runs essentially parallel to the longitudinal direction of guy cable 7. Guide 34 is designed as a longitudinal slot in which cylinder 31 with guide pin can run.

When hydraulic cylinder unit 30 is activated out of its unlocked position, shown in FIG. 11, cylinder 31 and with it locking piece 23 travel initially on an oblique to guy cable 7. Locking piece 23 is thereby moved on guy cable 7, so that it can grasp a cable clamp 25 molded on guy cable 7. This position is shown in FIG. 12.

If hydraulic cylinder 31 is now moved farther, that is, along the second travel path segment 36, guy cable 7 is drawn back into the guy support and is pre-stressed. FIG. 13 shows the fully pre-stressed position. Depending on the travel path of hydraulic cylinder unit 30, a considerable pre-stressing of the guy cable can be achieved.

In order to release the guy cable and unlock cable lock 23, the same steps are applied in reverse order. The actuation arrangement shown is characterized by a particularly compact arrangement. Despite the narrow space, it can be positioned inside guy support 6. Needless to say, theoretically the hydraulic guy cable pre-stressing can also be achieved with a cable lock arranged not on the guy supports but at the other end of the guy cable. However, the arrangement of the cable lock on guy support 6 is particularly preferred.

The invention claimed is:

1. Telescopic boom of a crane, comprising a pivotally-mounted section (2), telescopic sections (3,4) arranged to telescope out of the pivotally-mounted section (2), and a guy system (5) comprising at least one guy support (6) pivotally housed on one of the sections (2, 3, 4), and a guy cable (7) adjustably-supported on this guy support (6) for winding or unwinding with respect thereto, wherein said guy cable (7) running from the guy support (6) has radially-thickened areas (25) positioned at discrete intervals along said cable (7), and the guy support (6) comprises a cable lock (22) positioned to engage the thickened areas (25) and lock the cable (7) in place or move away from the cable (7) to allow the cable (7) to wind or unwind.

2. Telescopic boom according to claim 1, which the thickened areas consist of molded cable clamps (25).

3. Telescopic boom according to claim 2, in which the guy cable (7) has several thickened areas (25) positioned at intervals from one another and a cable lock that either allows the guy cable with one or more of its thickened areas (23) to run through or grasps one of the thickened areas (23), as desired.

4. Telescopic boom according to claim 3, in which the cable lock (22) has a swivelly-mounted locking piece (23) that can be moved into and out of the path of the running guy cable (7), and with a power jack (24) being provided to activate the locking piece (23).

5. Telescoping boom according to claim 2, additionally comprising cable pulleys (16), into which the guy cables (7) can be drawn, provided on the guy supports (6).

6. Telescopic boom according to claim 2, in which auxiliary cables (20) for hauling in the guy cables (7) are attached to the ends of the guy cables (7), and auxiliary coils (21) arranged for rolling up the auxiliary cables (20) being provided inside the guy supports (6).

7. Telescopic boom according to claim 1, in which the guy cable (7) has several thickened areas (25) positioned at intervals from one another and said cable lock either allows the guy cable with one or more of its thickened areas (25) to run through or grasps one of the thickened areas (25), as desired.

8. Telescopic boom according to claim 7, in which the cable lock (22) has a swivelly-mounted locking piece (23) that can be moved into and out of the path of the running guy cable (7), and with a power jack (24) being provided to activate the locking piece (23).

9. Telescoping boom according to claim 8, additionally comprising cable pulleys (16), into which the guy cables (7) can be drawn, provided on the guy supports (6).

10. Telescoping boom according to claim 7, additionally comprising cable pulleys (16), into which the guy cables (7) can be drawn, provided on the guy supports (6).

11. Telescopic boom according to claim 7, in which auxiliary cables (20) for hauling in the guy cables (7) are attached to the ends of the guy cables (7), and auxiliary coils (21) arranged for rolling up the auxiliary cables (20) being provided inside the guy supports (6).

12. Telescopic boom according to claim 1, additionally comprising cable pulleys (16), into which the guy cables (7) can be drawn, provided on the guy supports (6).

13. Telescopic boom according to claim 1, in which auxiliary cables (20) for hauling in the guy cables (7) are attached to the ends of the guy cables (7), and auxiliary coils (21) arranged for rolling up the auxiliary cables (20) being provided inside the guy supports (6).

14. Telescopic boom according to claim 13, having two guy supports that can be swiveled out of transportation position, in which they are essentially parallel to each other and are folded against one of the sections (2, 3, 4) into a raised operating position, in which the guy supports (6) are spread apart to form a V, and in which one guy cable (7) runs over each guy support.

15. Telescopic boom according to claim 14, in which the guy supports (6) are designed to have no cross-connections with one another.

16. Telescopic boom according to claim 1, in which by a hydraulic cylinder (30), the cable lock (22) can be moved longitudinally and the guy cable (7) can be pre-stressed by moving the cable lock (22).

17. Telescopic boom according to claim 16, in which the cable lock (22) can be frictionally engaged with the guy cable (7).

18. Telescopic boom according to claim 16, in which the cable lock can be positively engaged with the guy cable (7).

19. Telescopic boom according to claim 1, in which the cable lock (22) is guided in guide (34) in such a manner that the cable lock (22) can be engaged with or disengaged from the guy cable (7) along a first adjustment segment (35) and when locked can be moved along a second, connecting adjustment segment (36), in longitudinal cable direction.

20. Telescopic boom according to claim 19, in which a hydraulic cylinder (30) is pivoted at one end (33), with a piston rod, to swivel on the guy supports (6), and by a collar (31) thereof, carries the cable lock (22) and is led into the guide (34).

* * * * *